United States Patent [19]

Lindner

[11] Patent Number: 4,482,941

[45] Date of Patent: Nov. 13, 1984

[54] BARRIER LIGHT ASSEMBLY

[75] Inventor: Henry Lindner, Elgin, Ill.

[73] Assignee: Elgin Molded Plastics, Elgin, Ill.

[21] Appl. No.: 551,969

[22] Filed: Nov. 15, 1983

[51] Int. Cl.[3] ..... F21L 7/00

[52] U.S. Cl. ..... 362/186; 362/190; 362/191; 362/196; 362/200; 362/223; 362/224; 362/311; 362/375

[58] Field of Search ..... 362/186, 190, 191, 196, 362/200, 223, 224, 311, 375

[56] References Cited

U.S. PATENT DOCUMENTS 3,266,015 8/1966 Pickering et al. ..... 362/200 X
4,296,460 10/1981 Minoprio ..... 362/200
4,387,416 6/1983 Decker ..... 362/200 X
4,408,264 10/1983 Decker ..... 362/200

*Primary Examiner*—Stephen J. Lechert, Jr.
*Attorney, Agent, or Firm*—Hill, Van Santen, Steadman & Simpson

[57] ABSTRACT

An improved barrier light assembly is provided wherein a lens assembly composed of a pair of mating halves is secured to the upper portion of a base assembly by a threaded flanged collet. A peripheral outwardly extending integral neck of the lens assembly extends into the upper portion, and the collet threadably engages the neck. A pair of screw flights are employed which permits use of identical mating halves.

8 Claims, 8 Drawing Figures

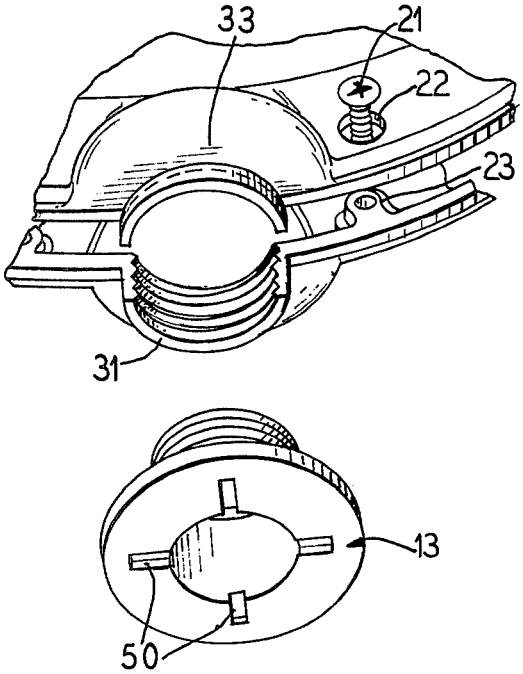
FIG. 5
FIG. 7
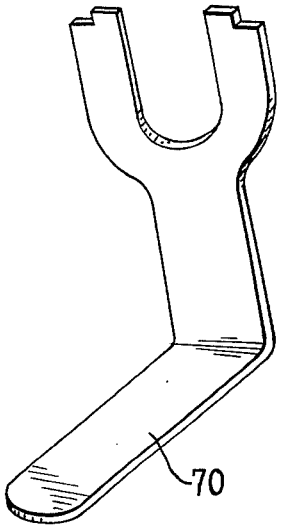
FIG. 6
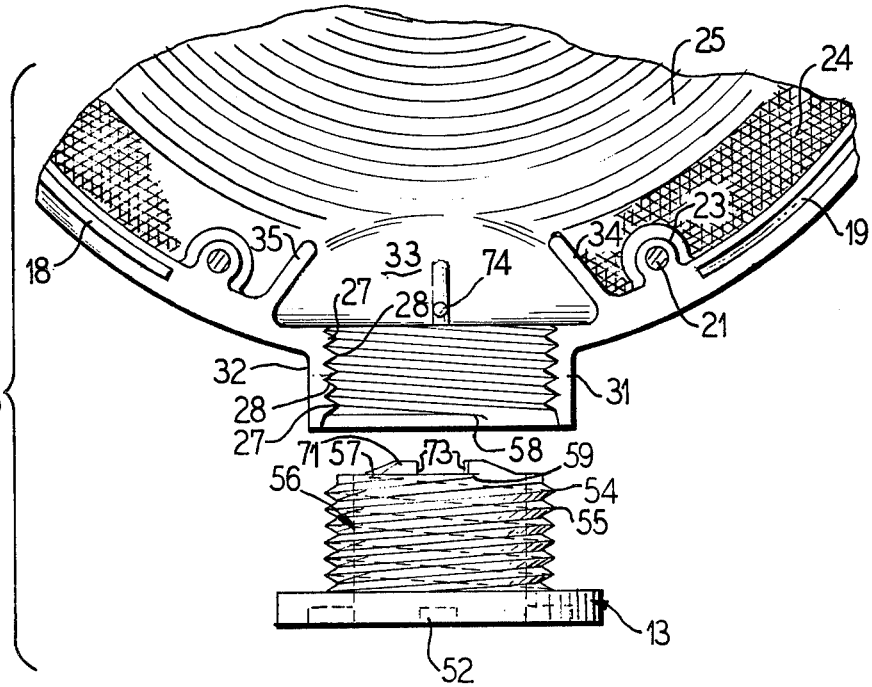

BARRIER LIGHT ASSEMBLY

BACKGROUND OF THE INVENTION

1. Field of the Invention

This invention lies in the field of barrier light assemblies.

2. Prior Art

Heretofore, in the art of barrier light assemblies, a lens assembly utilizing a pair of molded clear plastic lens halves was fabricated with an aperture in a side edge. In the body of the lens assembly adjacent to and extending about aperture a first large metal ring was situated. To mount this lens assembly to a supporting case member, a second large metal ring was located about an upper access hole in the case member and screws were extended axially relative to the access hole through the second ring and threadably engaged with the first ring.

This arrangement suffered from certain disadvantages. For one thing, during assembly, alignment problems arose not only in properly locating the first ring in the lens assembly but also in properly locating the second ring in the case member and in positioning the individual retaining screws between the first and second rings. Considerable time in manufacture was used in these locating, aligning, and positioning efforts which was, of course, undesirable because of adding to manufacturing costs.

For another thing, under actual field use conditions, a barrier light assembly has to be occasionally overhauled, disassembled, and reassembled. Typically, the metal components (e.g., the rings and the screws) become corroded and are difficult if not even impossible to take apart. Even if such metal components are removable, then such must be reassembled (preferably using new replacement parts), and the reassembly operation inherently and necessarily involves the same troublesome locating and aligning efforts above described which can substantially add to the cost of barrier light maintenance. Indeed, the duty life of a prior art barrier light is, practically speaking, shortened unnecessarily because of the time and assembly problems associated with this prior art arrangement.

The art needs a new and improved barrier light assembly wherein the foregoing problems are eliminated.

BRIEF SUMMARY OF THE INVENTION

More particularly, the present invention relates to a new and greatly improved barrier light assembly which utilizes a lens assembly, a case assembly, and a collet member to mount the lens assembly to the case assembly.

A principal object of the present invention is to avoid the above described prior art problems in barrier light assemblies and to provide a new and very useful improved barrier light assembly which can be simply and economically manufactured and serviced.

Thus, one object of the present invention is to provide a barrier light assembly which can be readily and simply assembled without ring alignment problems and mounting screw alignment problems.

Another object is to provide a barrier light assembly wherein, if desired, the means used to mount the lens assembly to the case assembly does not corrode or rust under actual field use conditions.

Another object is to provide a barrier light assembly wherein a lens assembly is mounted to a case assembly by means of a threaded flanged collet which can be, and preferably is, formed of molded plastic material.

Another object is to provide, in a barrier light assembly of the improved type indicated, a lens assembly having a peripheral outwardly projecting integral neck which is engagable with a case assembly and is secured thereto by means of screw engagement between such neck and a threaded flanged collet with the collet flange being torquable against an engaging portion of the case assembly.

Another and principal object is to provide, in a barrier light assembly of the improved type indicated, a pair of mating double helix screw flights for each of the collet and the lens assembly neck so that identical halves can be used for the lens assembly without the necessity to mold or otherwise fabricate both right and left handed neck halves, such as would be necessary if the threading in the lens assembly neck were formed of a single screw flight. The use of identical lens halves saves manufacturing costs and servicing costs. The combination of this invention utilizing identical lens halves and double helix screw flights is submitted to be surprising and unexpected.

Another object is to provide a barrier light assembly which is weatherable and which can be disassembled after an extended period of use for servicing and then reassembled for further use with minimum labor problems.

Other and further aims, objects, purposes, advantages, uses, and the like for the present invention will be apparent to those skilled in the art from the present specification taken together with the drawings.

BRIEF DESCRIPTION OF THE DRAWINGS

In the drawings:

FIG. 5 is a fragmentary exploded view of the lens assembly with the clamping collet therefor;

FIG. 6 is an enlarged fragmentary view similar to FIG. 5, but illustrating the interrelationship between mating threaded members;

FIG. 7 illustrates one embodiment of a mounting wrench adapted for use in combination with the clamping collet shown in FIGS. 5 and 6 during assembly and disassembly operations of the assembly shown in FIGS. 1-6.

DETAILED DESCRIPTION

Figure 1:
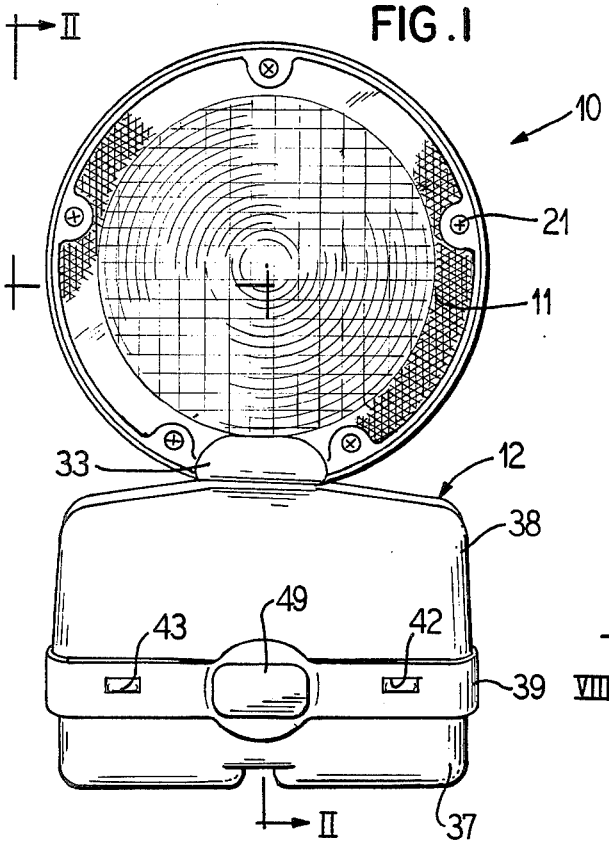
FIG. 1 is a perspective view of an improved weatherable barrier light assembly of the present invention.

Referring to the drawings, there is seen one embodiment of an improved weatherable barrier light assembly of the present invention herein designated in its entirety by the numeral 10. The structure of barrier light assembly 10 is seen to comprise a lens assembly 11, a case assembly 12, and a clamping collet 13.

The lens assembly 11 is comprised of a pair of identical lens halves 16 and 17. The circumferential periphery of each half 16 and 17 is preferably provided with an upstanding axially projecting bead 18 which projects axially in a hemicircular path. The remaining hemicircular periphery of each mating half of each lens half 16 and 17 is preferably provided with a circumferentially hemicircularly extending groove 19. Thus, when the two halves are placed in opposed assembled mating relationship relative to one another, the bead 18 on lens half 16 seats in the groove 19 on lens half 17, and vice versa, thereby to provide an innerlocking relationship between the respective halves 16 and 17 in their assembled configuration. An added advantage of this combination of beads 18 and grooves 19 is that it provides a precise interlocking aligning relationship between the respective identical lens halves 16 and 17.

To interconnect the respective halves 16 and 17 together any convenient fastening means can be employed. Here, a plurality of round head self-tapping screws are preferably provided (a total of five in the embodiments shown). Each of these screws 21 extends axially through a recess 22 integrally formed into the exterior peripheral surface portion of each half 16 and 17 as the screw projects into the body of each half 17, it extends through an intergral boss 23 formed in each half. As the screw is turned, it generates its own threads in the plastic material preferably comprising the lens halves 16 and 17. While each lens half is preferably formed of molded plastic of a clear, transparent character, a presently most preferred material for these lens halves 16 and 17 comprises a polycarbonate.

On the interior concave central surface portions of each lens half 16 and 17, there is formed a lenticular faceting, preferably of the Fresnel-type. A circumferentially extending band extending about the edge of the lenticular region 25 is further preferably provided with an internal band 24 which is comprised of retroreflective facets of the typical hexagonally shaped cube corner type.

The advantage of using a Fresnel-type lens is that the surface portions of each lens half 16 and 17 can thereby be axially flattened to produce a desired light focusing characteristic with minimal lens projection.

Since each of the lens halves 16 and 17 is identical to the other thereof, and since a pair of alignable threads 27 and 28 in the form of a double helx is defined in the neck portion of each of the respective lens halves 16 and 17, the result, when the halves 16 and 17 are in their assembled configuration, is a continuous screw flight pattern comprised of the continuous threads 27 and 28. Thus, no problems such as would occur with left handed and right handed mating lens halves need to be considered, and, furthermore, each lens half can be identical to the other. Thus, in the molding operation used to form each of the halves 16 and 17, a significant manufacturing convenience is achieved.

The assembled lens assembly 11 thus has an internally threaded neck 31 as an integral part thereof formed on a peripheral region 32 of the lens assembly 11.

Radially interiorly adjacent the peripheral region 32, there is preferably formed an enlarged integral seating portion 33 which circumferentially extends completely around the threaded neck 31 in the lens assembly 11. Thus, each lens half 16 and 17 has integrally formed therein one half of the enlarged integral seating portion 33. Stiffening ribs 34 and 35 are preferably formed in each lens half 16 and 17 in circumferentially adjacent relationship to each enlarged integral seating portion 33 so as to provide added rigidity for the completed seating portion 33 in the assembled lens assembly 11. To provide, if desired, additional bending resistance for the lens assembly 11 relative to case assembly 12, additional rib arrangements may be employed, if desired, as those skilled in the art will appreciate. Each of the lens halves 16 and 17 is so configured that it can be made by injection molding of plastic resin. Also optionally, the outwardly extending shoulder portions of each lens half 16 and 17 can have internally formed on surface portions thereof lenticular faceted portions which aid in enhancing viewability when the lens assembly 11 is viewed perpendicularly to the axis thereof.

The case assembly 12 is comprised of a lower portion 37 and an upper portion 38. Any convenient means for securing these portions 37 and 38 together can be employed. Here, the portion 38 is provided with a perimeter region 39 about the mouth thereof that is nestably receivable over mating portions of a perimeter 40 formed about the mouth of the lower portion 37. In perimeter portion 39, a plurality of slots 42 are formed preferably on one side thereof which are adapted for mating receipt therein of corresponding projections 43 mateably positioned in the perimeter region 40. Thus, when the upper portion 38 is mounted and engaged with the lower portion 37, a snap-type fit is achieved between upper and lower portions 38 and 37 , respectively.

In the embodiment shown, the lower portion 37 is provided with a centrally transversly extending channel 45 integrally formed therein. Where the channel terminates adjacent the perimeter region 40 an outwardly projecting flange extension 47 is provided. This flange 47 is adapted to matingly fit through an opening integrally formed in the perimeter portion 39 of upper portion 38. Thus, in the assembled case 12, the flange 47 nests in the opening 48 on one longitudinal side of case 12 while on the opposed side thereof, the projections 43 nest in the slots 42.

To positively secure together and lock the upper portion 38 to the lower portion 37, a standard bolt is extended through the channel 45 from one side of the assembled case and is threadably received in a securing nut member 49 that itself is mounted in the perimeter portion 39 at a location therein which is opposed to the opening 48. The securing nut member 49 is preferably riveted or otherwise fixed by any convenient fastening means to the upper portion 38 in a preliminary assembly operation for the upper portion 38. On either side of the channel 45 in the lower portion 37, a pair of pockets are defined integrally which serve for receipt therein a pair of batteries in the assembled and operative light assembly 101. The size of the cavity existing in the upper portion 38 is such as to accommodate the upper portions of the batteries used.

Figure 2:
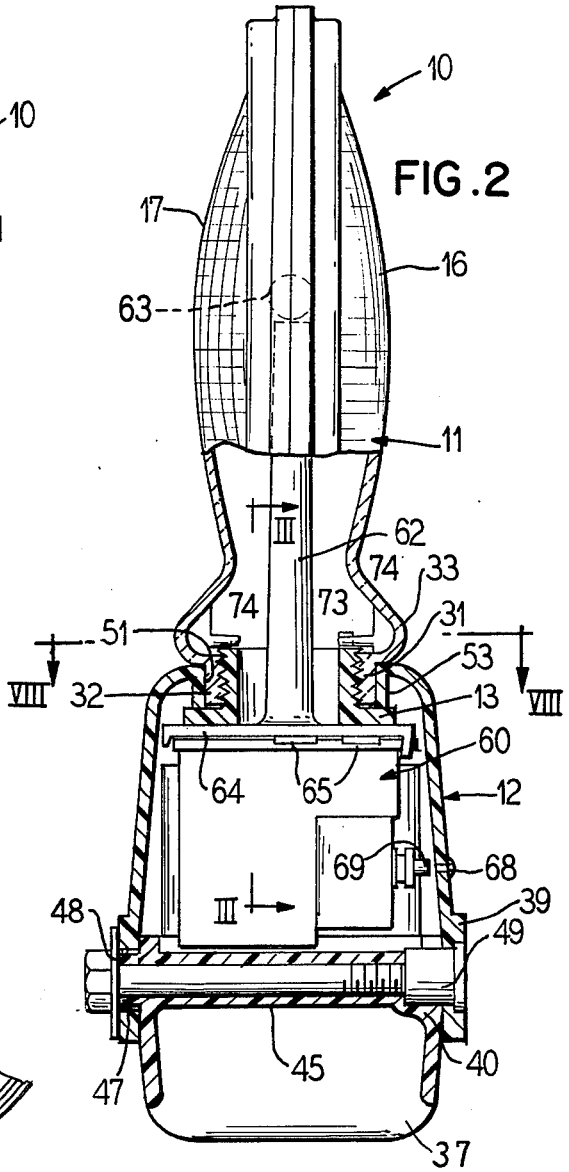
FIG. 2 is a vertical sectional view taken generally along the line II—II of FIG. 1.
Figure 3:
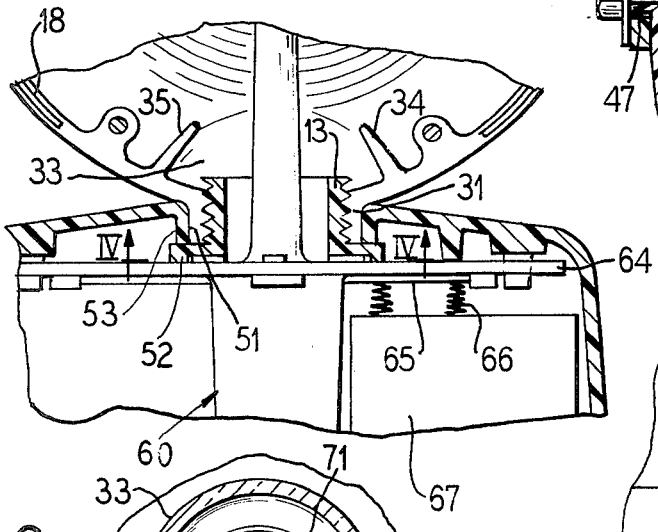
FIG. 3 is a fragmentary vertical sectional view taken generally along the line III—III of FIG. 2.
Figure 4:
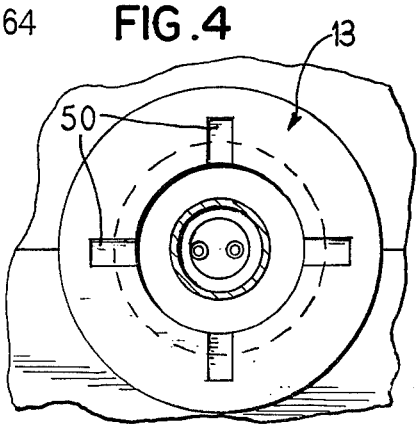
FIG. 4 is a fragmentary horizontal view taken generally along the line IV—IV of FIG. 3.
Figure 8:
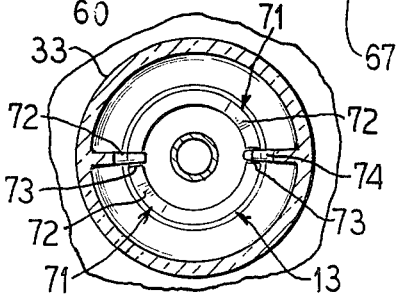
FIG. 8 is a sectional view taken generally along the line VIII—VIII of FIG. 2.

To assemble the lens assembly 11 with the case 12, the clamping collet 13 is employed. Thus, the threaded neck 31 of the lens assembly 11 is extended through a hole 51 formed in the upper central region of the upper portion 38 and the clamping collet 13 is then threadably engaged with the threads 27 and 28. The clamping collet 13 itself is comprised of a hollow threaded shank 56 which has integrally formed at one end thereof a head 52. In head 52, a plurality of spanner wrench pockets 50 (or other means, if desired) is provided so that means exist for tightening the clamping collet 13 into the threaded neck 31 as assembly progresses. The head or flange 52 of clamping collet 13 comes into face-to-face engagement with a supporting means, here exemplified by an inturned ridge 53 (see FIG. 2, for example) integrally formed with upper portion 38 of case 12 and circumferentially formed about hole 51. The lens assembly 11 becomes fixed relative to the upper portion 38 by torquing the clamping collet 13 against ridge 53 using a wrench 70 (see FIG. 7), or the like, thereby to achieve a secure engagement of collet 13 with the upper portion 38 and so that a seating occurs between the seating portion 33 and the upper portion 38 using the collet 13.

An optional but preferred feature of the present invention is illustrated in the embodiment 10. Thus, the collet 13 is provided with a pair of axially extending, diametrically opposed shoulders 71. On the lead-in side of each shoulder 71, relative to the direction of threading engagement of the threads 54 and 55, a camming ramp 72 is provided for each shoulder 71. A locking surface 73 is provided on the side of each shoulder 71 opposed (circumferentially) to the camming ramp 72. In addition, each lens half 16 and 17 is provided with a radially inturned locking finger 74 which is so positioned and configured as to be located in adjacent relationship to the inner end of the collet 13 when the collet 13 is fully engaged with the assembled lens assembly 11 (that is, the collet is threadably fully associated with the neck 31). When this is achieved, each finger will have moved up the adjacent camming ramp 72 and will have passed over the top of shoulder 71 into the locking surface 73. When this has been achieved, the collet 13 is retained in a locked configuration relative to the lens assembly 11. This arrangement is desired in order to prevent removal of the lens from the assembled light assembly 10 by mere rotation of the lens assembly 11 relative to the case 12. Thus, when the lens assembly 11 is rotated in an embodiment provided with this above described locking arrangement, the lens assembly merely rotates relative to the case 12 and no dissociation of the lens assembly can take place relative to the collet 13 or the case 12. Observe that the locking surface 73 and the locking finger 74 do permit parting from the inside of the upper portion 38 of case 12 by the following procedure. The lens assembly is retained in a fixed position while torque is applied to the collet 13 as by a wrench 70 with the amount of magnitude of the torque being sufficient to cause upward deflection of the fingers 74 to the point or position where the shoulders 71 are released from the fingers 74. Thus, the light assembly can be dissambled for servicing or the like as desired, and thereafter reassembled to achieve the same locking engagement between the shoulders 71 and the locking fingers 74.

The complimentary threads 27 and 28 are matingly engaged with complimentary threads 54 and 55 formed in the shank 56 of the clamping collet 13. Thus, relative to the start 57 of thread 54, there exits a start 58 of thread 27 which is in opposed relationship to the start 57 for the thread 54. Threads 28 and 55 also include starts which are in opposed relationship correspondingly.

A bulb and switch assembly 60 is provided which is received in the upper portion 38 of the case 12 after the lens assembly 11 is secured to the upper portion 38 by the clamping collet 13. This assembly 60 is known to the prior art and does not as such constitute a part of the present invention. The bulb and switch assembly 60 is provided with an upstanding pedestal 62 which extends up into the interior central region of the lens assembly 11, through the neck 31, and at the head or tip of the pedestal 62, a light receiving socket is positioned for mounting therein a small electric bulb 63. A stabilizing mounting plate 64 of the bulb and switch assembly 60 is provided with strip electric conductors 65 so that the batteries 67 are electrically engageable with the light bulb 63. Photocell means (not shown) is preferably provided in the bulb and switch assembly 60 so that the bulb 63 is automatically turned on at sunset and off at sunrise without need for a human attendant. The bulb and switch assembly 60 is itself preferably self contained and provided with an electrically insulative plastic housing. An access hole 68 is conveniently and preferably provided in a side wall of the upper portion 38. This hole 68 is in alignment with a plunger-type push button-actuated switch 69 associated with assembly 60 so that the assembly 60 can be turned on or off with a plunger formed of wire or the like (not shown but conventional) that is extendable through hole 68 into abutting contact with switch 69.

As those familiar with the art of barrier light assemblies will readily appreciate, it has become conventional to employ lens assemblies wherein only one identical lens half is comprised of a transparent material such as a polycarbonate plastic, or the like. In such an arrangement, the other identical lens half is comprised of an opaque material. The function of such opacity is to permit a barrier light assembly to be viewed from one direction only, such as is desired for safety reasons on interstate throughways, and the like, at night time.

From the foregoing description, it will be appreciated that in the present invention each lens half is identical to the other even as was done in the prior art except that now there is provided an integral threaded neck in the lens assembly. Integral, threads in each neck half are identical to those in the other half. In order to accomplish this result, two thread spirals are utilized. Thus, the special collet of this invention can be utilized, and no special left-hand and right-hand lens molds are required for each lens half which would otherwise be the case. Possibly separate threads could be cut into the neck of an assembled lens assembly, but this would add appreciably and undesirably to manufacturing costs, and so the threads are integrally formed.

The present invention eliminates the metal washer or ring assembly that was previously used in this art to clamp a lens assembly to a base (or case). The lens assembly, the case assembly, and the collet of this invention can be, and preferably are, of rust proof construction.

The prior art light assemblies embodiments required a multiplicity of screws and metal rings and a longer assembly time in manufacture. The metal retaining washers or rings of the prior art had to be installed in the lens assembly at the time when the two halfs thereof were brought together and secured with screws, whereas, in the present arrangement, the lens assembly is assembled independently of any auxiliary case mounting means.

In the prior art, a plurality of screw connections were employed between lens assembly and case. A metal washer or ring which had to be preliminarily threaded was used and it had to be aligned with a clamping washer or ring in the case. These materials are not used in the present invention. In the prior art, a barrier light assembly used a lot more parts and was much more difficult to assemble. In the prior art assembly, rusting rapidly could occurr in the field, making repairs difficult if not impossible to accomplish, whereas, with the present barrier light assembly, repairs are simply and readily accomplished through the use of a single collet-type fastener. Also, here only a single tool member is needed to secure the present clamping collet in place.

The new barrier light assembly of this invention offers weatherable and a substantial reduction in assembly time and in manufacturing and servicing costs. In this assembly, the new collet facilitates adjustment of the lens assembly relative to the case assembly, if desired.

Although the teachings of my invention have herein been discussed with reference to specific embodiments, it is to be understood that these are by way of illustration only and that others may wish to utilize my invention in different designs or applications.

I claim:

1. A weatherable barrier light assembly comprising in combination:

(A) a lens assembly comprising:

(1) a pair of substantially identically configured lens halves which are matingly and abuttingly engaged with one another along opposed peripheral edge portions to define an interior chamber therebetween, (2) at least one of said lens halves being comprised of a substantially transparent material, (3) each of said lens halves having an integral, hemi-cylindrical, internally threaded neck half extending radially outwardly from a region of said edge portion thereof, (4) each said hemi-cylindrical neck half cooperating with the other thereof in an engaged said lens assembly to provide a cylindrical neck radially outwardly projecting from said peripheral edge portions and wherein a first pair of discrete screw thread spirals extend continuously about internal circumferential walls of such neck generally in an axially equally spaced relationship to one another, one of said screw flights starting in a radially outer edge portion of said neck at a first location which is opposed 180° relative to said neck relative to a second location in said outer edge portion where the other of said screw flights starts, and (5) fastening means for fastening together said lens halves in said engagement;

(B) a case assembly comprising:

(1) an upper portion and a lower portion, the perimeter region of one of said portions being matingly engaged with the perimeter region of the other of said portions, said portions defining an interior chamber therebetween, (2) securing means for fastening together said portions in said engagement, and (3) said upper portion having an upwardly opening hole defined therein with supporting means circumferentially extending thereabout;

(C) a collet member comprising:

(1) a cylindrical shank, (2) an integral radially outwardly projecting head flange, and (3) a second pair of discrete screw threads extending spirally and continuously about outer circumferential walls of said shank generally in axially equally spaced relationship to one another, said second pair of screw threads being threadably and matingly engageable with said first pair of intertwined screw flights; and (D) the interrelationship between said lens assembly, said case assembly, and said collet member being such that, in the assembled said barrier light assembly, said neck is extendable into said hole, said shank is so threadably engageable with said neck, and said head flange in torquable into abutting retaining engagement with said supporting means.

2. The barrier light assembly of claim 1 wherein said fastening means is provided by a plurality of bosses integrally defined in each lens half adjacent said peripheral edge portions, and a self-tapping screw means is axially, relative to said lens assembly, threadably extendable into each one of the axially aligned pairs of bosses produced in the assembled said lens assembly and extends from one of said lens halves into the other thereof.

3. The barrier light assembly of claim 1 wherein said region of each said lens half about the inner end of said neck is radially, relative to said neck, outwardly expanded to provide support means in said lens assembly for rigidifying said lens assembly relative to said case assembly in the assembled said barrier light assembly.

4. The barrier light assembly of claim 1 wherein said collet member is provided with receiving pockets defined in said portions of said head flange opposed to said shank to accommodate wrench means.

5. The barrier light assembly of claim 1 wherein, in each of said lens halves, about one half of a peripheral edge portion there is provided with an axially upstanding ridge about the remaining one half of said peripheral edge portion there is provided an axially inwardly extending groove so that, when a pair of said lens halfs are so engaged with one another in the assembled said lens asssembly, said ridge of one half is matingly received in said groove of the other of said halves.

6. The barrier light assembly of claim 1 wherein each of said lens halves are comprised of said transparent material.

7. The barrier light assembly of claim 1 wherein one of said lens halves is comprised of a substantially opaque material.

8. The barrier light assembly of claim 1 wherein:

(A) said collet member has integral locking shoulder measure associated with the other end of said shank, (B) each of said lens halves has integral locking finger means located at the inner end of said neck, and (C) the interrelationship between said locking shoulder means and said locking finger means being such that said locking finger means is associatable with said locking shoulder means to provide locking engagement therebetween in the assembled said light assembly.

* * * * *